United States Patent [19]

Hibino

[11] Patent Number: 4,722,199

[45] Date of Patent: Feb. 2, 1988

[54] THERMALLY INSULATED BIN STRUCTURE

[75] Inventor: Takashi Hibino, Toyoake, Japan

[73] Assignee: Hoshizaki Electric Co., Ltd., Toyoake, Japan

[21] Appl. No.: 937,006

[22] Filed: Dec. 2, 1986

[30] Foreign Application Priority Data

Dec. 9, 1985 [JP] Japan ..... 60-188517
Dec. 13, 1985 [JP] Japan ..... 60-279266

[51] Int. Cl.[4] ..... F25C 5/18

[52] U.S. Cl. ..... 62/344; 49/488; 49/501; 62/457; 312/253

[58] Field of Search ..... 62/344, 457; 220/4 R, 220/4 C; 49/488, 501; 312/214, 253, 257 A

[56] References Cited

U.S. PATENT DOCUMENTS 2,454,303 11/1948 Brodheim ..... 62/457 X
2,682,155 6/1954 Ayres et al. ..... 62/344 X
2,963,885 12/1960 Loewenthal ..... 62/344
3,059,452 10/1962 Griffin ..... 62/457
3,144,078 8/1964 Morton et al. ..... 62/344 X
3,234,750 2/1966 Swanson ..... 62/344 X
3,802,220 4/1974 Pompo ..... 62/457 X
4,474,033 10/1984 Baker ..... 62/457
4,545,211 10/1985 Gaus ..... 62/115

*Primary Examiner*—William E. Tapolcai
*Attorney, Agent, or Firm*—Wenderoth, Lind & Ponack

[57] ABSTRACT

A thermally insulated bin structure comprises an inner casing having an open top and a closed bottom for storing articles, an outer casing disposed outside of the inner casing and a connecting portion for interconnecting the inner and outer casings at respective lower end portions thereof, the inner casing, the outer casing and the connecting portion being formed as an integral unit by a one-piece molding method. A front frame having an opening is fitted on the front portion of the unit, and a door is pivotably mounted on the front frame so as to open and close the opening. The cabinet accommodating therein an ice making unit is fitted into the outer casing and the front frame.

6 Claims, 9 Drawing Figures

THERMALLY INSULATED BIN STRUCTURE

BACKGROUND OF THE INVENTION

1. Field of the Invention

The present invention relates to a thermally insulated bin structure for refrigerating equipment such as ice making machines, refrigerators and the like or heat insulating equipment for holding articles at an appropriate level of temperature. In particular, the present invention concerns novel improvements in thermally insulated bins and cabinets attached thereto for allowing them to be assembled in a facilitated manner. Further, the invention concerns a door structure suited for use in the thermally insulated bin.

2. Description of the Prior Art

Heretofore, as a thermally insulated bin for refrigerating equipment or heat insulating equipment of the type mentioned above, there have been proposed and employed various structures. Typically, thermally insulated bins are composed of an inner casing, an outer casing and a suitable heat insulating material to be disposed therebetween. The inner and outer casings are fabricated separately and independently from one another. Accordingly, when an outer casing made of metal is to be integrally connected to an inner casing formed of resin, it has normally been necessary for the bottom fixture members of the inner and outer casings to be connected together by suitabl securing means for fixedly positioning the inner and outer casings relative to each other.

Further, in a hitherto known ice making machine, as shown in FIG. 9, before a trim panel 4 is mounted on an ice storage section 1 of the thermally insulated bin, the ice storage section 1 has to be fixedly mounted by means of screws (not shown) on a pair of substantially rectangular lateral frames 2 held at a predetermined distance by a bottom spacer plate 3 secured thereto by clamping screws (not shown). The trim panel 4 is then mounted on the ice storage section 1 from above, and the panel 4 as well as the lateral frames 2 are secured by means of clamping screws. Further, a back panel or plate 5 is fixedly secured to the trim panel 4 at the rear side thereof by screws. The thermally insulated bin of the structure mentioned above is disclosed in Japanese Utility Model Publication No. 27328/1985.

However, the conventional thermally insulated bin as described above has disadvantages in that relatively complicated securing means are required for integrally connecting the inner and outer casings in addition to a great number of clamping screws or bolts for connecting together the ice storage section, the lateral frames, the bottom spacer plate, the trim panel and the back plate to one another, involving a lot of time taken for assembly as well as increased manufacturing costs.

SUMMARY OF THE INVENTION

Accordingly, a primary object of the present invention is to eliminate the disadvantages mentioned above and provide a thermally insulated bin structure which can be assembled in a facilitated and simplified manner with significant reduction in manufacturing costs.

According to the broadest aspect of the present invention, the thermally insulated bin structure includes an inner casing for storing articles therein, an outer casing provided outside of the inner casing, an interconnecting portion for connecting together the inner and outer casings at respective lower portions, the inner casing, the outer casing and the interconnecting portion being formed in an integral unit by a one-piece molding process. The thermally insulated bin structure may further include a trim panel mounted on an upper peripheral edge portion of the outer casing with the lower end portion of the trim panel being fitted into a groove formed in the upper peripheral edge portion of the outer casing.

More specifically, each of the outer and inner casings includes a front portion, right and left lateral portions and a rear portion, wherein a groove is formed in the top end of the lateral and rear walls of the outer casing. The thermally insulated bin structure may further include a hollow cabinet disposed on the outer casing with the lower end portion of the cabinet being engaged in the groove formed in the outer casing, a front frame defining a front opening and having a lower end portion snugly engaged with the front upper end portions of the outer and inner casings, respectively, a door pivotally supported by the front frame so as to open and close the opening defined by the front frame. The front frame has an upper portion inclined toward the rear side of the outer casing at an acute angle with respect to the plane defined by the groove. The door has an outer peripheral edge which is disposed in opposition to or facing the surface of the front frame defining the front opening when the door closes the opening, and around which is mounted a gasket having a frictional contact portion which is brought into contact with the opposite surface of the front frame when the door is closed. The door includes a front door panel having a frame-like extension extending inwardly, a heat insulating material layer accommodated within the frame-like extension, and a rear door panel having an extension extending outwardly so as to engage with the extension of the front door panel. Mounting recesses are formed in the extension of the front door panel, while resilient claws are formed in the extension of the rear door panel, so that the front door panel, the heat insulating material and the rear door panel can be mutually combined through engagement of the resilient claws with the mounting recesses.

The extension of the rear front panel may have a plurality of spaced ribs arranged along the peripheral direction and a plurality of convex portions formed at locations spaced from the ribs at a predetermined distance toward the front door panel. The gasket is attached to the rear door panel by being fitted between the ribs and the convex portions. The cabinet has an opening formed in a region corresponding in position to the front frame, and the lateral end portions of the cabinet defining the opening are retained by retaining portions of the front frame.

With the thermally insulated bin structure according to the present invention, neither positioning means nor mounting means are required for interconnecting the inner and outer casings because both casings are integrally connected together by the integral interconnecting portion with a predetermined distance being maintained between the casings. This greatly facilitates the assembly of the inner and outer casings while significantly reducting the manufacturing costs.

BRIEF DESCRIPTION OF THE DRAWINGS

In the course of the following detailed description, reference will be made to the attached drawings in which.

DESCRIPTION OF THE PREFERRED EMBODIMENT

Now, referring to FIGS. 1 to 8, there is shown a thermally insulated bin structure according to an exemplary embodiment of the invention applied to an ice making machine. It should however be understood that the invention can be applied not only to an ice making machine but also to refrigerating equipment such as refrigerators and the like as well as equipment for maintaining the temperatures within a storage or storehouse at an appropriate level.

Figure 3:
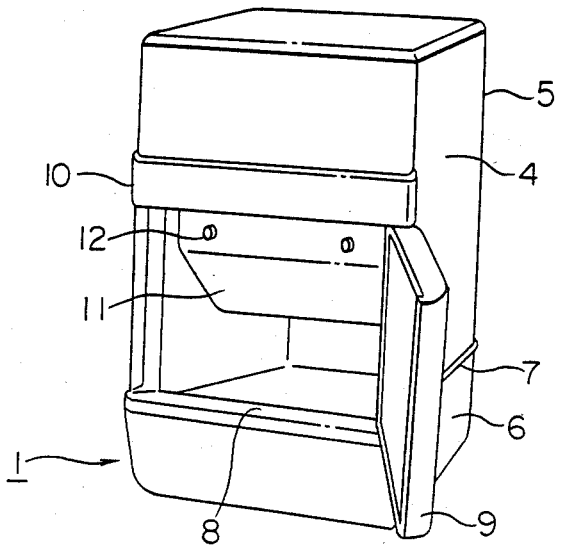
FIG. 3 is a perspective view showing schematically an outer appearance of the ice making machine shown in FIG. 1.

Referring to FIG. 3 which schematically shows an outer appearance of an ice making machine including an ice storage section 1, and a trim panel 4 disposed on an outer casing 6 of the storage section 1 with a lower end portion of the trim panel 4 being fitted or engaged in a groove 7 formed in an upper end of the outer casing 6. A back panel 5 is removably mounted on the trim panel 4 at the rear side thereof, and an opening 8 is formed in the trim panel 4 at the front side thereof and is provided with a door 9 supported by a front frame 10 so as to be freely opened and closed. Disposed within the ice storage section 1 at an upper portion thereof is a water reservoir or tank 11 fixedly attached by two clamping bolts 12 to the panel 4 side.

Figure 1:
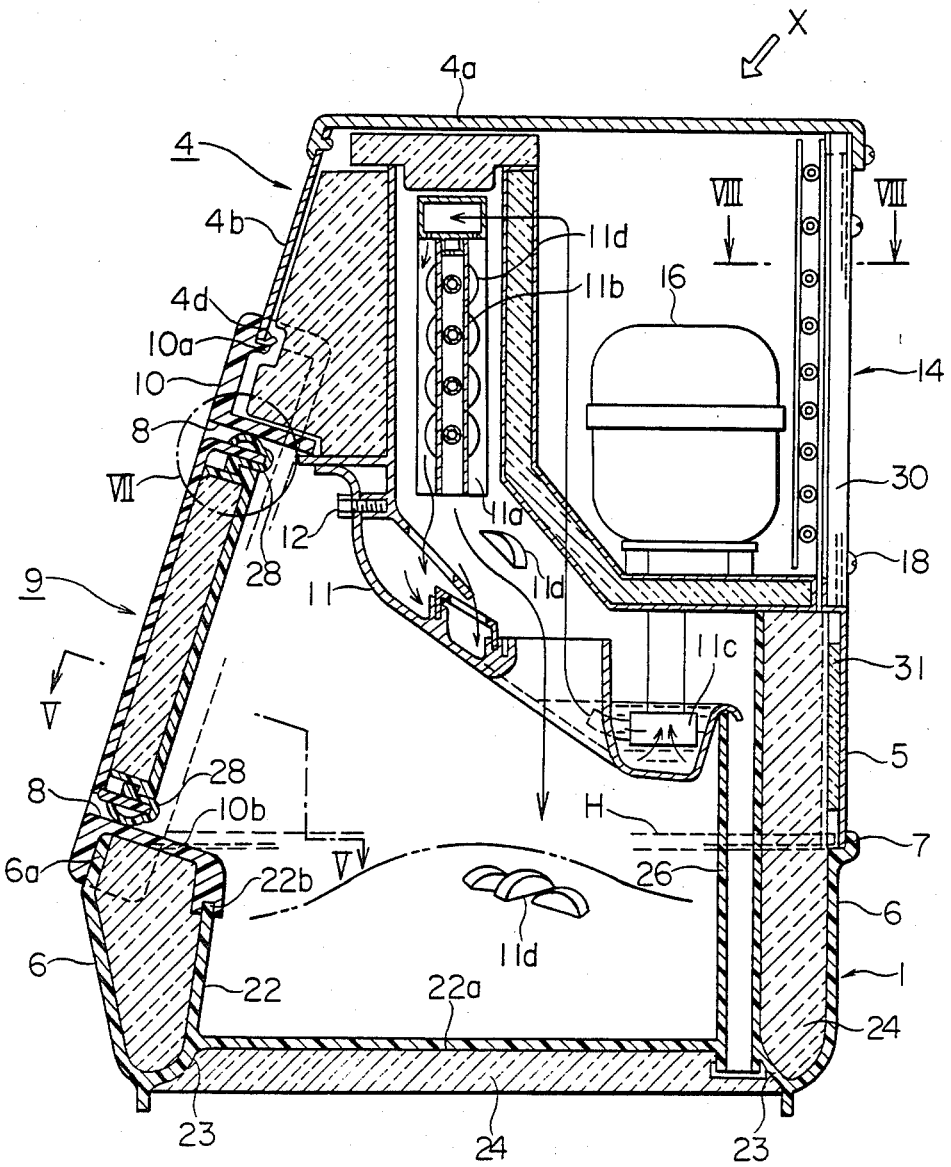
FIG. 1 is a view showing in elevation a vertical section of an ice making machine incorporating therein a thermally insulated bin structure according to an exemplary embodiment of the invention.
Figure 2:
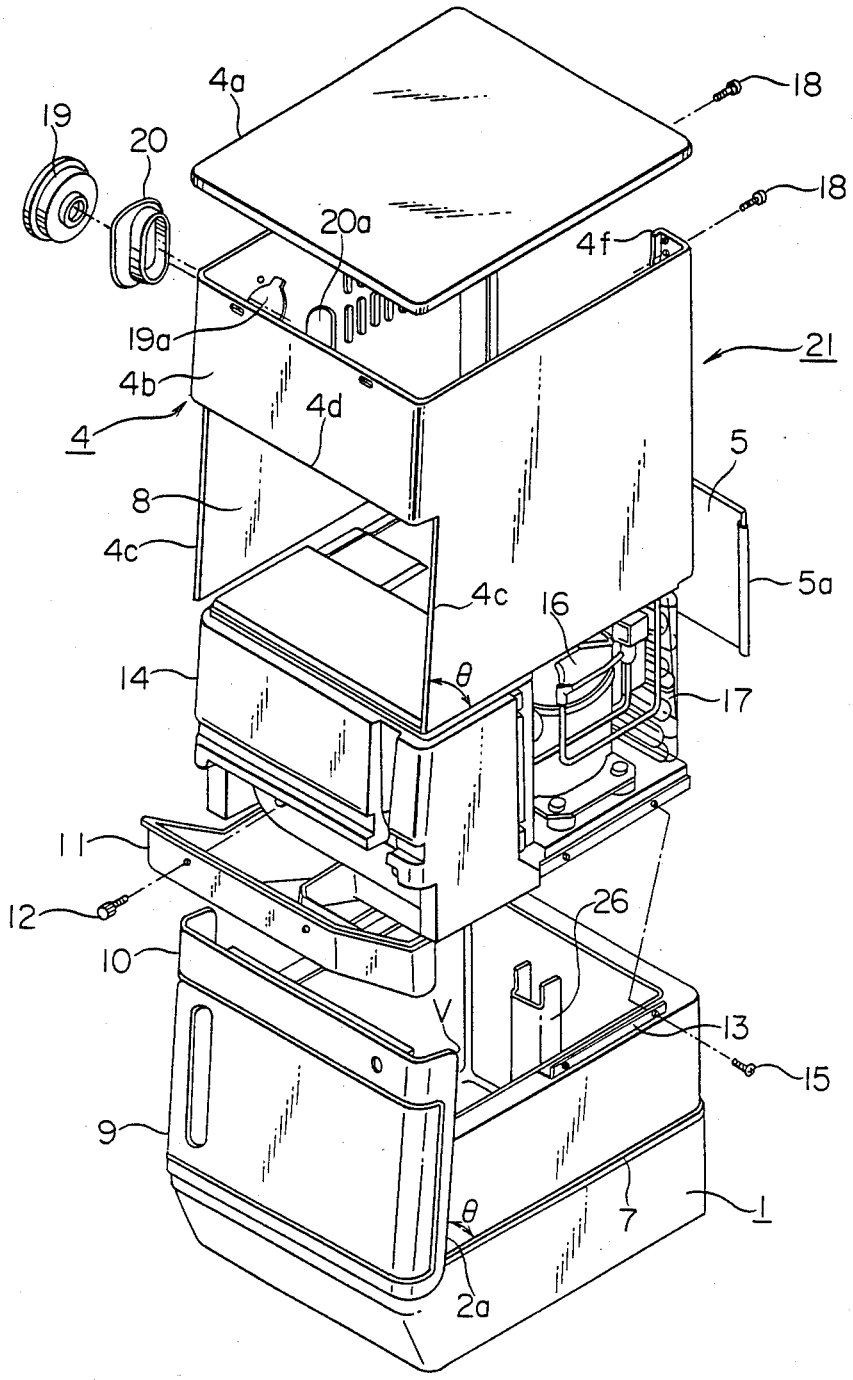
FIG. 2 is an exploded perspective view of the ice making machine shown in FIG. 1.
Figure 4:
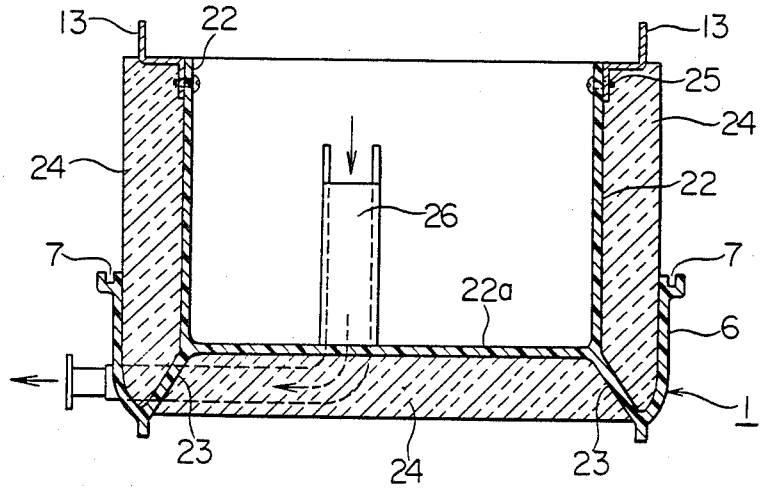
FIG. 4 is a vertical sectional view of an ice storage section incorporated in the ice making machine shown in FIG. 1.

Referring to FIGS. 1 and 2, a mounting plate member 13 having a double-L-like cross section as shown in FIG. 4 is mounted on a top end portion of the ice storage section 1 for fixedly mounting an ice making section or unit 14 including the abovementioned water tank 11 by means of clamping bolts 15. The ice making unit 14 comprises in addition to the water tank 11, a compressor 16, a condenser 17, a pair of freezing plates 11*a*, an evaporating tube 11*b*, a water circulation pump 11*c* and other components, all being enclosed by a cabinet 21 comprising the trim panel 4. The ice-making water contained in the water tank 11 is circulated through the water circulation pump 11*c* to be fed repeatedly onto the freezing plates 11*a*, while a coolant is caused to flow through the vaporizer 11*b* and the condenser 17 by the compressor 16. As a result, ice pieces 11*d* are formed on the freezing plates 11*a* in a known manner.

A top panel or plate 4*a* is interference-fitted to the trim panel 4 at the top end thereof. Further, mounting holes 19*a* and 20*a* formed in a lateral side wall of the trim panel 4 are respectively fitted with a water supply port cover 19 and an electric power supply inlet cover 20 (FIG. 2). In this manner, the substantially box-like cabinet 21 is constituted by the trim panel 4, the top panel 4*a* and the back panel 5. As is best shown in FIG. 1, a front panel 4*b* constituting an upper front portion of the cabinet 21 is disposed to incline towards the rear of the bin. The front frame 10 mentioned hereinbefore is also inclined in a similar manner. Consequently, the front frame 10 forms an acute angle $\theta$ with respect to a substantially horizontal plane H defined by the upper end of the outer casing 6 in which the groove 7 mentioned hereinbefore is formed.

A hook-like portion 10*a* is formed integrally with the front frame 10 along the top edge thereof for receiving the lower end 4*d* of the front plate 4*b* in engagement therewith. On the other hand, the lower end portion 10*b* of the front frame 10 is adapted to engage with the top end 6*a* of the outer casing 6 and the top end 22*b* of the inner casing 22 from above, whereby mutual engagement and positioning of the lower end 10*b* of the front frame 10 and the ice storage section 1 can be accomplished.

Again referring to FIGS. 1 and 2, the inner casing 22 and the outer casing 6 of the ice storage section 1 are realized in the form of a one-piece structure formed simultaneously from a suitable resin, wherein the inner casing 22 and the outer casing 6 are integrally connected at respective bottom portions through an interconnecting portion 23. However, it should be noted that the interconnecting portion 23 need not be made in a continuous form as viewed in a plane but may be provided with perforations in an appropriate pattern or alternatively formed with oblong slots connected by ligaments, without providing any obstacle to attaining the object aimed by the present invention.

Disposed between the inner casing 22 and the outer casing 6 is a heat insulating material 24 such as a foamed plastic material. The heat insulating material 24 can be formed by injecting an appropriate foaming agent into the space between the inner casing 22 and the outer casing 6 after the ice storage section 1 has been placed in a proper fixture. It will be noted that the heat insulating layer is also provided in a space underlying the bottom wall 22*a* of the inner casing 22.

Figure 5:
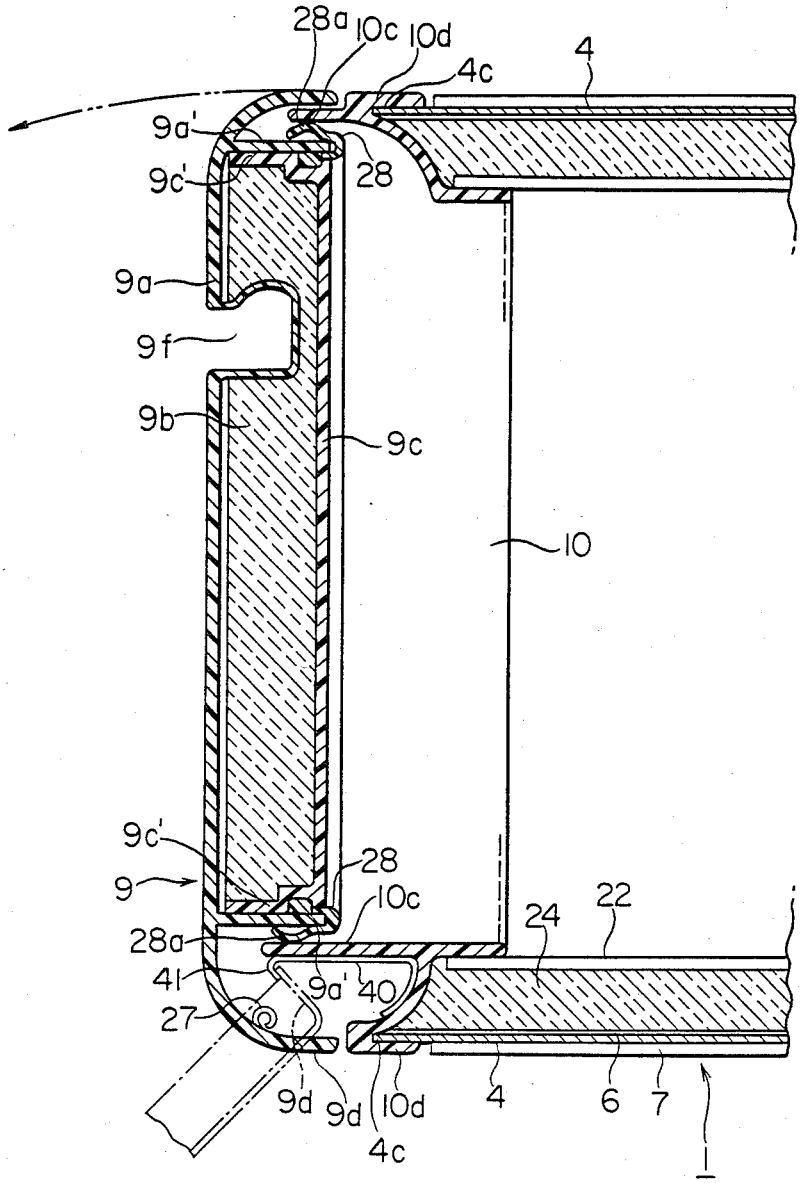
FIG. 5 is a partial sectional view taken along a line V—V in FIG. 1.

Next referring to FIGS. 1, 2 and 4, the mounting members 13 are fixedly secured to the inner casing 22 at the top end thereof by clamping screws 25, as will be best seen in FIG. 4. A water discharge conduit or passage 26 is provided within the inner casing 22 for allowing water overflowing from the water tank 11 to be discharged outwardly. The passage 26 extends through the heat insulating material layer 24 and the outer casing 6 to the outside. Referring to FIG. 5, the door 9 is constituted by a front door panel 9*a* and a rear door panel 9*c* having frame-like extensions 9*a*' and 9*c*', respectively, which extend in opposition to each other, and a heat insulation material layer 9*b* disposed between the door panels 9*a* and 9*c*. The door 9 is supported by vertical pivotal supporting means 27 disposed at one side of the door 9 so that it can be opened only in one direction. An annular gasket 28 is held as sandwitched between the extensions 9*a*' and 9*c*' of the front door panel 9*a* and the rear door panel 9*c* and has a contact portion 28*a* in sliding contact with projections 10*c* of the front frame 10 for thermally shielding the interior of the storage section 1 from the ambient air. Further, lateral end portions 4*c* defining the opening 8 of the trim panel 4 are respectively inserted into retaining portions 10*d* provided in the front frame 10 for securely positioning the lateral end portions 4*c* of the panel 4. Disposed outside of the front frame 10 is a stopper 40 in a contacting state with the projection 10*c* and the retaining portion 10*d* of the lateral or side plate of the front frame 20 located on the side of the pivotal supporting means 27 so that upon opening of the door 9 to a predetermining angle, an engaging piece 9*d* of the pivotally supported door 9 abuts against a projecting pad portion 41 of the stopper 40 to thereby prevent the door 9 from being opened too far.

Figure 6:
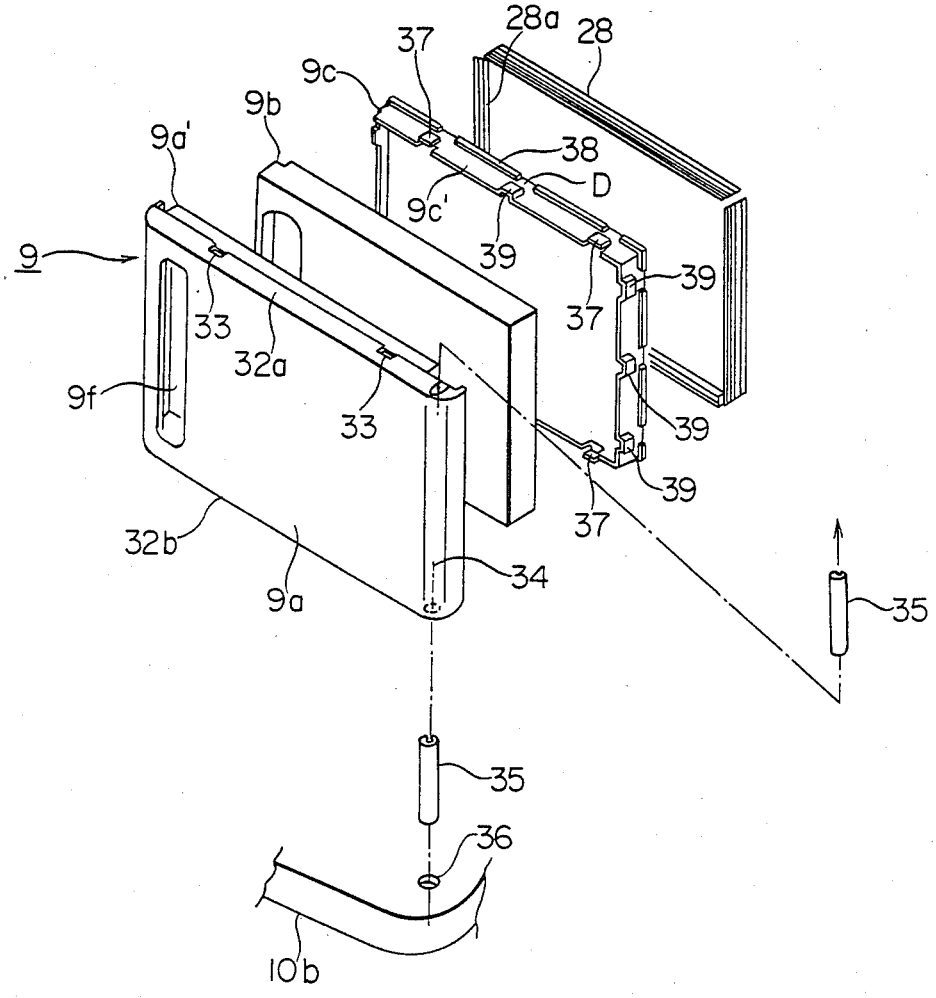
FIG. 6 is an exploded perspective view showing a door used in the ice making machine of FIG. 1.
Figure 7:
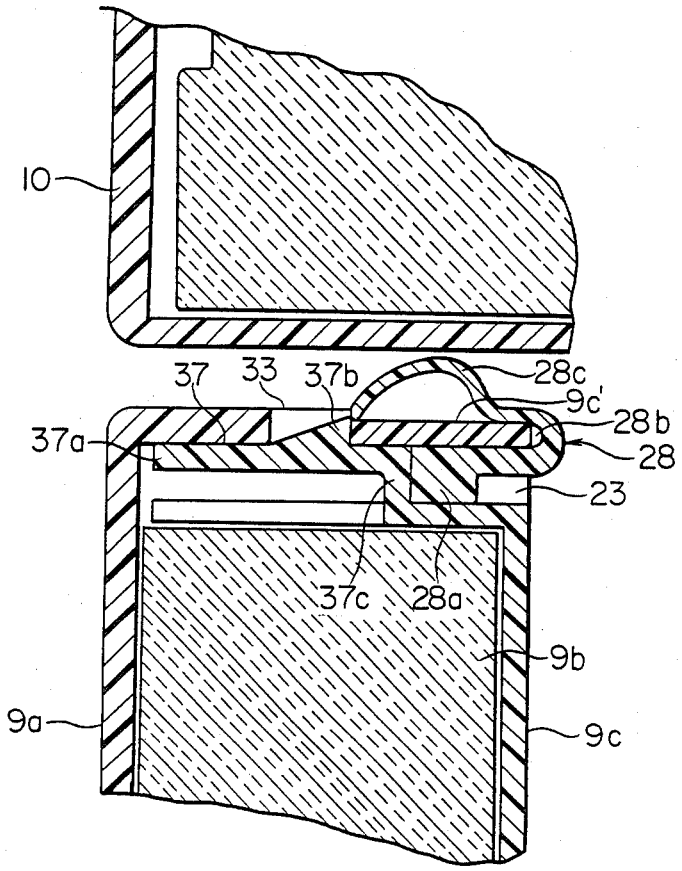
FIG. 7 is an enlarged sectional view of a portion enclosed by a circle shown at VII in FIG. 1.

Now, describing the structure of the door 9 in more detail with reference to FIGS. 5 to 7, a vertically extending grip recess 9*f* is provided in the outer surface of the front door panel 9*a* formed of a resin with the extension 9*a'* extending inwardly or backwardly from the rear surface of the front door panel 9*a*. Further, a pair of engaging recesses 33 are formed with a predetermined distance therebetween in an upper end portion 32*a* and a lower end portion 32*b* of the front door panel 9*a*. The afore-mentioned pivotal supporting means 27 comprises pivotal shaft receiving holes 34 formed at the side opposite to the grip recess 9*f* of the front door panel 9*a*, pivotal shafts 35 fitted into the corresponding holes 34 and holes 36 formed in the upper end lower portions of the front frame 20, these components cooperating to constitute the pivotally supporting means 27 for supporting the door 9 to be opened and closed only in one direction. The frame-like extension 9*a'* of the front door panel 9*a* contains therein the heat insulating material 9*b* behind which the rear door panel 9*c* having the frame-like extension 9*c'* engages with the inner side of the extension 9*a'* of the front door panel 9*a*. Resilient engaging or mounting claws 37 are formed in the rear door panel 9*c* at the upper and lower ends thereof, respectively, and engage in the recesses 33, respectively. Formed in the peripheral portion of the rear door panel 9*c* are a plurality of ribs 38 extending in the peripheral direction with a predetermined space D between the adjacent ribs. Provided in opposition to the spaces between the ribs 38, respectively, are a plurality of outwardly extending convex portions 39. The pivotal shaft 35 is formed of a resilient metal plate wound cylindrically and is commonly referred to as a spring pin. For inserting the pivotal shaft 35 in the holes 34 and 36, the former is forcibly compressed to a diameter smaller than that of the latter. After the insertion, the pivotal shaft 35 can be snugly and securely fitted in the holes 34 and 36 under its inherent restorative force.

The gasket 28 mentioned hereinbefore is disposed along the extension 9*c'* with the leg portion 28*a* thereof being snugly disposed between the ribs 38 and the claws 37 and the convex portions 39. When the front door panel 9*a* and the rear door panel 9*c* are fitted together, projecting portions 37*b* respectively, projecting from horizontal portions 37*a* of the resilient claws 37 of the rear door panel 9*c* enter the latch holes 33, respectively formed in the front door panel 9*a*, whereby the front door panel 9*a* and the rear door panel 9*c* are integrally united with each other, as will be seen in FIG. 7. The gasket 28 has an ear-like cross section having a bend 28*b* which receives therein the tip portion of extension 9*c'* when the front door panel 9*a* and the rear door panel 9*c* are combined together. The elastic sliding contact portion 28*c* located outside of the extension 9*c'* bulges substantially in a C-like form in cross section and contacts in frictional engagement with the surfaces of the upper end portion 10*a* and the lower end portion 10*b* of the front frame 10 (see FIGS. 1 and 7)

Figure 8:
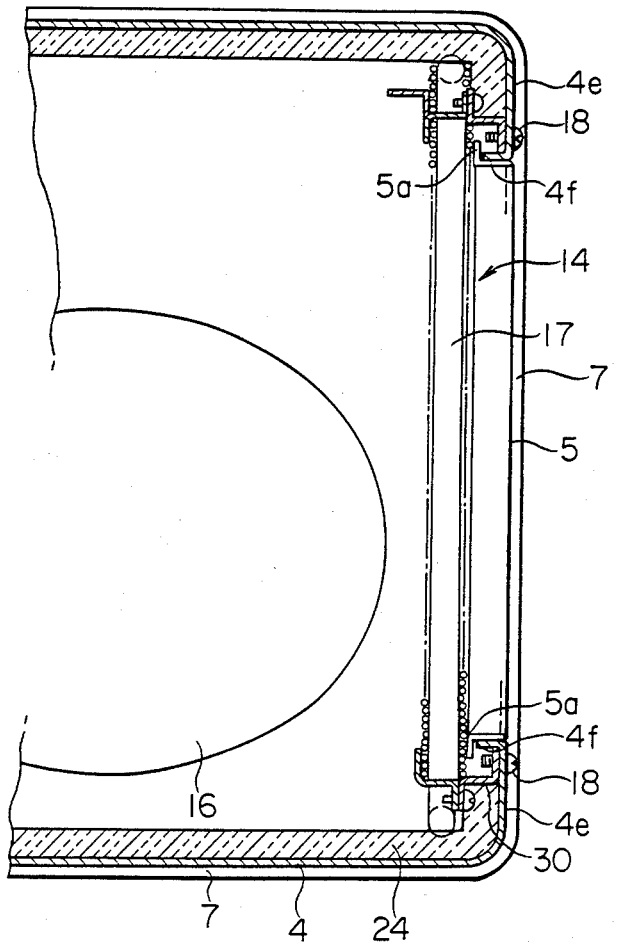
FIG. 8 is a partial sectional view taken along a line VIII—VIII in FIG. 1.
Figure 9:
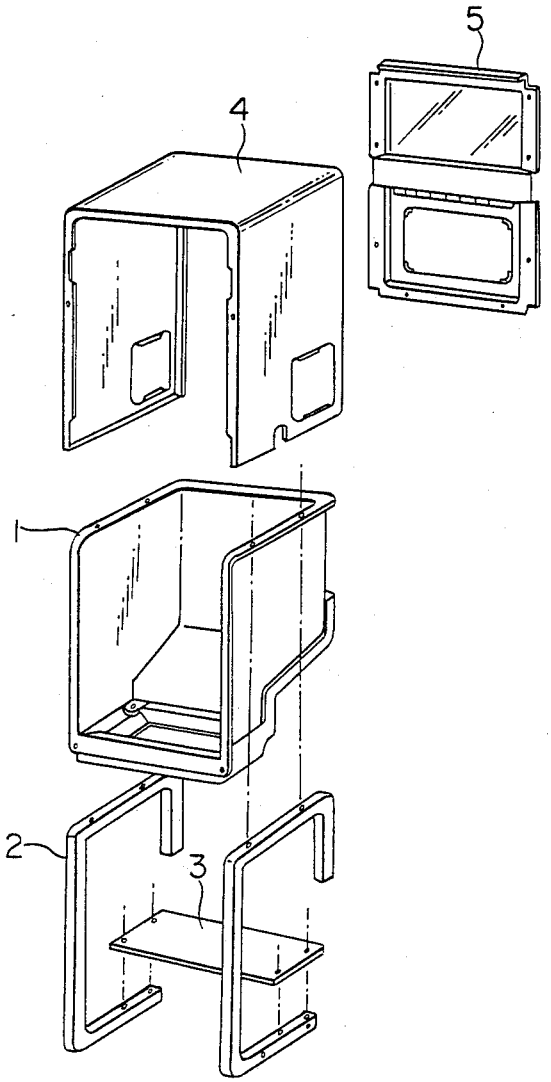
FIG. 9 (PRIOR ART)
FIG. 9 is an exploded perspective view showing a structure of a conventional thermally insulated bin.

Referring to FIGS. 1 and 8, the condenser 17 is mounted on a pair of vertically extending mounting column members 30 on which the rear panel portion 4*e* of the trim panel 4 is secured by clamping screws 18. In this manner, the trim panel 4 is held positively in a predetermined position through cooperation with the groove 7 of the ice storage section 1, the retainer 10*d* of the front frame 10 and the hook 10*a*. Further, by tightening the clamping screws 18, the trim panel 4 is pressed toward the front frame 10 and secured as a whole stably so that neither vibration nor rattle will be produced.

As described hereinbefore, since the lateral end portion 4*c* of the trim panel 4 forms an acute angle with respect to the horizontal plane H including the groove 7 and is fittingly received in the corresponding retaining portion 10*d* of the front frame 10, the trim panel 4 is prevented from being undesirably withdrawn upwardly. Further, since the ears 5*a* formed in the rear panel 5 at both sides thereof extend toward the lateral sides of the trim panel 4, the rear panel 5 is pressed against the heat insulating layer 24 by hold-down portions 4*f* formed inwardly in the rear panel portion 4*e* of the trim panel 4 (see FIG. 1). A suitable cushioning material 31 such as sponge is interposed between the heat insulating material layer 24 and the rear panel 5 for the purpose of preventing vibration from occurring, as is shown in FIG. 1.

For assembling the thermally insulated bin of the structure as described above, the bottom end portion of the front frame 10 is first placed on the ice storage section 1 constituted by the inner casing 22 and the outer casing 6 formed integrally through the interconnecting portion 23, and the front frame 10 is mounted at the acute angle $\theta$ to the horizontal plane H, as is illustrated in FIGS. 1 to 8. Subsequently, the door 9 is mounted within the opening 8 of the front frame 10 by the pivotal supporting means 27 so that the door 9 can be opened only in one direction. Then, the ice making unit 14 is disposed on the ice storage section 1 and secured to the mounting members 13 by means of the clamping screws 15.

Next, when the trim panel 4 is positioned on the ice making unit 14 in the direction indicated by an arrow X in FIG. 1, the lateral end portion 4*c* of the trim panel 4 and the bottom edge 4*d* of the front panel portion 4*b* abut the retaining portion 10*d* and the hook 10*a* of the front frame 10, respectively, to be retained thereby. Thus, the trim panel 4 is secured to the front frame 10. At the same time, the bottom end of the trim panel 4 is engaged in the groove 7 formed in the ice stocker section 1, whereupon the procedure for fitting the trim panel 4 is completed.

Next, the rear portion 4*e* of the trim panel 4 is secured to the mounting columns 30 by the clamping screws 18. By tightening the clamping screws 18, the trim panel 4 is forcibly pressed toward the front frame 10, whereby the trim panel 4, the front frame 10 and the ice making unit 14 are rigidly interconnected and secured together.

Finally, the rear panel 5 is inserted between the hold-down portions 4*f* of the trim panel 4 from above, being followed by mounting of the top panel 4*a* on the trim panel 4.

With the thermally insulated bin having the structure as described above, there can be obtained the various effects mentioned below.

(1) Since the inner casing and the outer casing can be formed integrally and simultaneously due to the presence of the interconnecting portion, the procedure for producing the inner casing and outer casing can be greatly facilitated, whereby a predetermined distance can be assured between the inner and outer casings without the need for any additional adjusting and connecting procedures.

(2) Since the mounting of the trim panel onto the outer casing can be essentially carried out through interference-fitting, the time taken for assembling the thermally insulated bin can be significantly reduced with the number of parts being considerably decreased, resulting in significant reduction in the manufacturing cost.

(3) Since neither clamping screws nor bolts are exposed in the front face or wall or the lateral wall, it becomes possible to provide ice making machines, refrigerators and the like which enjoy excellent aesthetic design features having no comparison in the past.

(4) Notwithstanding the extremely simple structure, there can be provided ice making machines, refrigerators or the like which can be securely assembled to enjoy a rigid structure.

(5) Because the door can be assembled and mounted using fitting alone without resorting to the use of clamping screws, etc. the time taken for assembling and mounting the door can be reduced, involving additional reductions in the manufacturing cost.

(6) In contrast to conventional bins in which the gasket is attached to the rear surface of the rear door panel, the thermally insulated bin according to the present invention is provided with a gasket which is mounted so as to enclose the outer periphery of the door. By virtue of this feature, the area of the access opening of the thermally insulated bin can have extremely large dimensions when compared with the access opening of a conventional bin, whereby the handling for placing and taking out articles into and from the bin can be simplified.

(7) Since the gasket, the pivotally supporting shafts and the stopper can not be seen from the front side even when the door is opened and because no screws or the like are exposed at all, there can be provided a thermally insulated bin of eminently good design.

(8) Because the door is so mounted in the closed state that the upper portion thereof is inclined towards the rear, the door can shut by manually closing the door to the position corresponding to the vertical attitude. Thus, the door can remain in a closed state without the need for any special latch mechanism.

(9) Since the front and rear door panels are secured together through the engagement of the engaging recesses and the resilient claws, disassembly and assembly for maintenance purposes can be greatly facilitated.

It should be understood that although the preferred embodiment of this invention is described solely by way of example, modifications and improvements within the scope of this invention may be suggested by the present disclosure to those skilled in the art. Accordingly, the scope of this invention should not be limited to the embodiment.

What I claim is:

1. A thermally insulated bin structure comprising an inner casing having an open top, a lower portion and a closed bottom for storing articles therein; an outer casing disposed outside of said inner casing and having a lower portion; and an interconnecting portion for connecting said inner and outer casings at said respective lower end portions, said inner casing, said outer casing and said interconnecting portion being an integral unit;

each of said outer and inner casings having a front portion, lateral side portions and a rear portion, top ends of the lateral side portions and the rear portion of the outer casing having a groove formed therein;

a hollow cabinet disposed on said outer casing with the bottom end of said cabinet being fitted in said groove of said outer casing, said cabinet includes an opening formed therein; a front frame defining an opening corresponding in position to the opening in said cabinet, said front frame including a bottom end portion engaged with a front upper end portion of said outer casing and a front upper end portion of said inner casing, and a door pivotally supported on said front frame to selectively open and close said opening, said front frame further including an upper portion engaged with a forward portion of said cabinet, and inclined toward the rear portion of said outer casing at an acute angle with respect to the plane in which said groove lies.

2. The thermally insulated bin structure according to claim 1, wherein said door has an outer peripheral portion facing a surface of said front frame defining said opening when said door closes said opening, said outer peripheral portion being equipped with a gasket having a frictional contact portion which bears on said surface.

3. The thermally insulated bin structure according to claim 2, wherein said door includes a front door panel having a frame-like extension extending inwardly and mounting holes formed in said extension, a heat insulating material contained within said frame-like extension, and a rear door panel having an extension extending outwardly to engage snugly with said extension of said front door panel and having resilient mounting claws formed in said extension of said rear door panel, said front door panel, said heat insulating material and said rear door panel being mutually interconnected through engagement of said resilient claws in said recesses.

4. The thermally insulated bin structure according to claim 3, wherein the extension of said rear door panel has a plurality of spaced ribs arranged in the peripheral direction, and a plurality of convex portions spaced apart from said ribs with a predetermined distance toward said front door panel, said gasket being disposed between said ribs and said convex portions to be thereby snugly fitted to said rear door panel.

5. The thermally insulated bin structure according to claim 1 wherein lateral end portions of said cabinet defining said opening being snugly engaged in corresponding retaining portions formed in said front frame at lateral portions thereof.

6. The thermally insulated bin structure according to claim 1, wherein said inner casing defines an ice storing chamber for storing ice pieces and said cabinet encloses an ice making unit for manufacturing the ice pieces.

* * * * *